US008192910B2

(12) United States Patent
Katoh et al.

(10) Patent No.: US 8,192,910 B2
(45) Date of Patent: Jun. 5, 2012

(54) IMAGE FORMING METHOD, IMAGE FORMING APPARATUS AND PROCESS CARTRIDGE

(75) Inventors: Hiroaki Katoh, Nagaoka (JP); Naoki Nakatake, Kobe (JP); Masayuki Hagi, Minoo (JP); Yoshitaka Sekiguchi, Nishinomiya (JP); Kazuoki Fuwa, Kawanishi (JP); Yoshihiro Mikuriya, Nishinomiya (JP); Hideaki Yasunaga, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 476 days.

(21) Appl. No.: 12/490,739

(22) Filed: Jun. 24, 2009

(65) Prior Publication Data

US 2010/0009282 A1 Jan. 14, 2010

(30) Foreign Application Priority Data

Jul. 9, 2008 (JP) ..... 2008-179612

(51) Int. Cl.
*G03G 13/08* (2006.01)
*G03G 9/00* (2006.01)
*G03G 13/20* (2006.01)

(52) U.S. Cl. ..... 430/123.51; 430/108.1; 430/108.6; 430/119.82; 430/124.1

(58) Field of Classification Search ..... 430/108.1, 430/108.6, 108.8, 119.82, 123.5, 123.51, 430/124.1
See application file for complete search history.

(56) References Cited

U.S. PATENT DOCUMENTS 6,087,059 A * 7/2000 Duggan et al. ..... 430/108.22
6,746,808 B2 * 6/2004 Nakamura et al. ..... 430/108.21
2005/0058924 A1 * 3/2005 Miyakawa ..... 430/108.6
2006/0275686 A1 12/2006 Kadota et al.
2007/0059625 A1 3/2007 Yamamoto et al.
2007/0190443 A1 8/2007 Hagi et al.
2007/0207399 A1 9/2007 Kadota et al.
2008/0075505 A1 3/2008 Nagamori et al.
(Continued)

FOREIGN PATENT DOCUMENTS

CN 101154072 A 4/2008
(Continued)

OTHER PUBLICATIONS

Office Action issued Aug. 31, 2011, in Chinese Patent Application No. 200910140140.8.

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

An image forming method, including charging the surface of an electrostatic latent image bearer by a charger; irradiating the surface of the electrostatic latent image bearer to form an electrostatic latent image thereon; developing the same with a toner to form a toner image; transferring the toner image onto a recording medium; and fixing the toner image thereon, wherein the charger is a charging roller contacting the electrostatic latent image bearer to charge the same, having a ten-point surface roughness of 5 to 30, and the toner includes a binder resin, a colorant, a release agent and an external additive including a composite oxide including titanium oxide in an amount of 80 to 95% by weight and silicon oxide, having a core-shell structure formed of a core including the titanium oxide and a shell including the silicon oxide and has a BET specific surface area of 50 to 100 $m^2/g$.

8 Claims, 1 Drawing Sheet

U.S. PATENT DOCUMENTS

2009/0208862 A1* 8/2009 Anno et al. ..... 430/108.7

FOREIGN PATENT DOCUMENTS

JP 2002-182424 6/2002
JP 2003-43785 2/2003
JP 2004-177747 6/2004
JP 2004-233407 8/2004
JP 2005-164873 6/2005
JP 2006-220765 8/2006

* cited by examiner

IMAGE FORMING METHOD, IMAGE FORMING APPARATUS AND PROCESS CARTRIDGE

BACKGROUND OF THE INVENTION

1. Field of the Invention

The present invention relates to an electrophotographic image forming technology, and more particularly to an image forming method, and an image forming apparatus and a process cartridge downsizable stably producing quality images without foggy or hazy images even when repeatedly producing images at lower cost and high speed.

2. Discussion of the Background

Low-end laser beam printers are recently being produced at lower cost, downsized and having higher printing speed to comply with expanding demands from SOHO (Small Office/Home Office) and consumers. Particularly, each part and device of the printers are required to be smaller and simplified for downsizing and lower cost of the printers. For example, charging methods are not exceptional. Corona charging methods are used for conventional electrophotographic image forming methods. However, the corona chargers needing high-voltage electric power are expensive and produce ozone harmful to environment. Therefore, inexpensive and small charging rollers are recently being used.

Charging rollers classified into two types contacting an image bearer and not contacting an image bearer. It is difficult to design the non-contact charger having a fixed discharge gap and it needs high voltage, which increases the cost.

Meanwhile, the contact charger is capable of controlling a discharge gap with a nip thickness, and easier to design and downsize than the non-contact charger.

However, the contact charger is likely to have an influence of a noise on an image bearer, i.e., contamination such as a toner remaining thereon after cleaned and a free external additive, resulting in contamination of charging roller and poor charging. The toner is removable with a cleaning member such as a nonwoven fabric and a brush, but the external additive free from the toner is difficult to remove. When the charging roller has a small surface roughness, e.g., not greater than Rz 5, the uniformity of the surface improves and uneven charging seems prevented. However, the charging roller and the image bearer slip each other actually, and particularly when a contact pressure therebetween is low, e.g., not greater than 4, they slip more each other and the image bearer is unevenly charged. When the surface roughness is larger than predetermined, e.g., not less than Rz 20, the surface uniformity is insufficient and the image bearer is unevenly charged.

In low-cost small printers, the one-component developing method without using a carrier is typically used more than the conventional two-component developing method. Even the one-component developing method includes the above-mentioned contact and non-contact charging methods, and the contact charging method is preferably used.

silicon oxide and titanium oxide are mainly used as external additives for use in a toner for the one-component developing method. The external additives peel off from the toner due to a stress between a developing roller and the image bearer and a stress when the image bearer is cleaned, resulting in contamination of the charging roller. Particularly when the charging roller is contaminated with titanium oxide, the electrical properties of the charging roller, i.e., the chargeability thereof is impaired, resulting in image quality problems. However, it is difficult to control chargeability with only silicon oxide without using titanium oxide. Particularly, it is difficult to prevent production of hazy images caused by exaggerated feeding amount of a toner on the developing roller due to increase of charge amount in an environment of low temperature and low humidity.

Various methods of improving the cleanability of a toner are studied.

Japanese published unexamined application No. 2004-177747 discloses a toner for developing electrostatic latent images, formed of an external additive including a particulate core-shell formed silica-coated metal oxide including a core layer formed of a member selected from the group consisting of titanium dioxide, aluminum oxide and zinc oxide, and a shell layer formed of silica and a particulate silica having a volume-average particle diameter of from 5 to 20 nm; and a particulate colorant.

Japanese published unexamined application No. 2002-182424 discloses a toner capable of producing images having high density without producing foggy or hazy images and filming even when continuously producing images for a long time, formed of a particulate colorant (and a binder resin); and an external additive including a particulate core-shell formed silica-coated metal oxide including a core layer formed of a member selected from the group consisting of titanium dioxide, aluminum oxide and zinc oxide, and a shell layer formed of silica and a particulate silica having an average particle diameter of from 10 to 30 nm and sphericity of from 1 to 1.3.

However, neither of the above-mentioned applications specifies a ratio of the core and shell, and the external additive has a small particle diameter and is likely to be freed from the toner. Such a toner is difficult to avoid contaminating a charging roller.

Japanese published unexamined application No. 2004-233407 discloses a method of specifying a surface potential after testing the durability of a toner layer on a developing roller to collect a toner remaining on a photoreceptor after transferring a toner image.

Japanese published unexamined application No. 2003-043785 discloses a method of forming an electrostatic latent image on a latent image bearer with a charging roller uniformly charged, which is formed of a metallic core material coated with a rubber layer having a surface roughness of from 0.5 to 10 μm, and which is further coated with a polyurethane resin having a glass transition temperature of from 30 to 80° C.; and developing the electrostatic latent image with a toner including boron or phosphorus in an amount of from 0.1 to 100 ppm to form a toner image for preventing contamination of the charging roller and foggy images. Namely, the born and phosphorus included in the toner prevents the toner from scattering, producing foggy images and filming.

However, the above-mentioned method cannot completely remove contamination due to an external additive free from the toner, and particularly when titania (titanium dioxide) is used as an external additive, the charging roller is more contaminated.

Japanese published unexamined application No. 2006-220765 discloses a method of cleaning a residue such as a toner or an external additive adhering to a charge with an image developer or an image bearer of an image forming apparatus.

However, this costs much and needs additional parts, resulting in difficulty of meeting lower reduction and downsizing. Particularly, this is not applicable to small printers.

As mentioned above, a charging roller having a surface roughness Rz of from 5 to 20 enables the charging roller and an image bearer to be driven by each other and the image bearer can uniformly be charged. A charging roller simply having such a surface roughness Rz scrapes a toner on an electrostatic latent image bearer and an external additive free therefrom worsens contamination (filming) of the charging roller. Silicon oxide and titanium oxide are mainly used as an external additive for a toner (for a one-component developing method). When a charging roller is contaminated with titanium oxide, the chargeability thereof is impaired, resulting in image quality problems. When only the silicon oxide is used without using the titanium oxide, the charging roller is difficult to have chargeability, resulting in difficulty of preventing production of abnormal images.

Because of these reasons, a need exists for an image forming method capable of meeting lower cost, downsizing and high-speed printing, preventing contamination of a contact charging roller due to a toner and its external additives even when repeatedly used for long periods, stably producing quality images without production of foggy and hazy images with a contact charging method (a charging roller) preventing a toner from being charged too much even in an environment of low temperature and low humidity.

SUMMARY OF THE INVENTION

Accordingly, an object of the present invention is to provide an image forming method capable of meeting lower cost, downsizing and high-speed printing, preventing contamination of a contact charging roller due to a toner and its external additives even when repeatedly used for long periods, stably producing quality images without production of foggy and hazy images with a contact charging method (a charging roller) preventing a toner from being charged too much even in an environment of low temperature and low humidity.

Another object of the present invention is to provide an image forming apparatus using the image forming method.

A further object of the present invention is to provide a process cartridge using the image forming method.

These objects and other objects of the present invention, either individually or collectively, have been satisfied by the discovery of an image forming method, comprising:

charging the surface of an electrostatic latent image bearer by a charger;

irradiating the surface of the electrostatic latent image bearer by an irradiator to form an electrostatic latent image thereon;

developing the electrostatic latent image by an image developer with a toner to form a toner image;

transferring the toner image onto a recording medium by a transferer; and fixing the toner image on the recording medium by a fixer, wherein the charger is a charging roller contacting the electrostatic latent image bearer to charge the electrostatic latent image bearer, having a ten-point surface roughness Rz of from 5 to 30, and the toner comprises a binder resin, a colorant, a release agent and an external additive, wherein the external additive comprises a composite oxide including titanium oxide and silicon oxide, and wherein the composite oxide has a core-shell structure formed of a core including the titanium oxide and a shell including the silicon oxide, includes the titanium oxide in an amount of from 80 to 95% by weight, and has a BET specific surface area of from 50 to 100 $m^2/g$.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
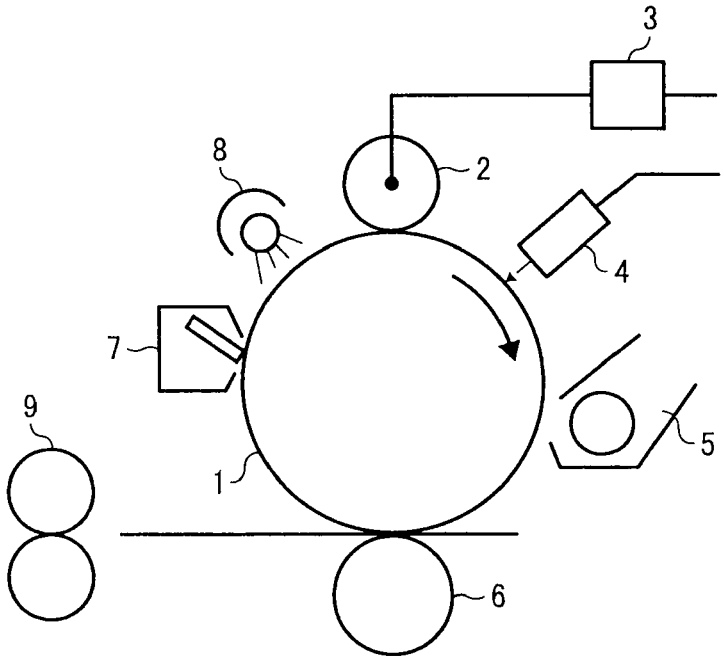
FIG. 1 is a schematic view for explaining an electrophotographic image forming apparatus of the present invention.

The present invention provides an image forming method capable of meeting lower cost, downsizing and high-speed printing, preventing contamination of a contact charging roller due to a toner and its external additives even when repeatedly used for long periods, stably producing quality images without production of foggy and hazy images with a contact charging method (a charging roller) preventing a toner from being charged too much even in an environment of low temperature and low humidity. Particularly, the present invention relates to an image forming method, comprising:

charging the surface of an electrostatic latent image bearer by a charger;

irradiating the surface of the electrostatic latent image bearer by an irradiator to form an electrostatic latent image thereon;

developing the electrostatic latent image by an image developer with a toner to form a toner image;

transferring the toner image onto a recording medium by a transferer; and fixing the toner image on the recording medium by a fixer, wherein the charger is a charging roller contacting the electrostatic latent image bearer to charge the electrostatic latent image bearer, having a ten-point surface roughness Rz of from 5 to 30, and the toner comprises a binder resin, a colorant, a release agent and an external additive, wherein the external additive comprises a composite oxide including titanium oxide and silicon oxide, and wherein the composite oxide has a core-shell structure formed of a core including the titanium oxide and a shell including the silicon oxide, includes the titanium oxide in an amount of from 80 to 95% by weight, and has a BET specific surface area of from 50 to 100 $m^2/g$.

The image forming method and the image forming apparatus of the present invention use a charging roller contacting and charging the electrostatic latent image bearer as a charger, and having a ten-point average surface roughness Rz of from 5 to 30.

When the ten-point average surface roughness Rz is less than 5, the uniformity of the surface improves and uneven charging seems prevented, but the charging roller and the image bearer slip each other actually, and particularly when a contact pressure therebetween is low, e.g., not greater than 4, they slip more each other and the image bearer is unevenly charged.

When the ten-point average surface roughness Rz is larger than predetermined, e.g., not less than Rz 20, it is necessary to see the charging roller is not unevenly charged, particularly when greater than 30.

The image forming method and the image forming apparatus of the present invention use a toner including an external additive. Namely, the external additive includes at least a composite oxide formed of titanium oxide and silicon oxide. The composite oxide has a core-shell structure formed of a core including titanium oxide and a shell including a silicon oxide, and includes titanium oxide in an amount of from 80 to 95% by weight. In addition, the composite oxide has a BET specific surface area of from 50 to 100 $m^2/g$.

When the composite oxide includes titanium oxide in an amount less than 80% by weight, the resultant toner does not have sufficient chargeability. When greater than 95% by weight, the resultant toner improves in charge buildability, but deteriorates in saturated charge quantity, resulting in production of foggy images. Middle-sized external additives prevent members such as charging rollers from being contaminated.

When the composite oxide has a BET specific surface area less than 50 $m^2/g$, the external additive has a large particle diameter, does not adhere to a toner and becomes free to contaminate the charging roller. When the composite oxide has a BET specific surface area greater than 100 $m^2/g$, the external additive has a small particle diameter and noticeably buries in a toner. Therefore, the composite oxide does not improve the charge buildability of a toner, resulting in production of foggy images due to a feebly-charged toner.

The image forming method and the image forming apparatus of the present invention are capable of preventing contamination of a contact charging roller due to a toner and its external additives even when repeatedly used for long periods, preventing a toner from being charged too much even in an environment of low temperature and low humidity, stably producing quality images without production of foggy and hazy images, and meeting lower cost, downsizing and high-speed printing in printers, facsimiles and complex machines.

As mentioned above, the image forming method and the image forming apparatus of the present invention use a toner including an external additive. The toner excluding the external additive may be a toner prepared by known pulverization methods or polymerization methods provided the toner includes at least a binder resin, a colorant and a release agent, and preferably a toner prepared by pulverization methods in terms of low production cost.

In addition, the toner preferably has a volume-average particle diameter of from 3 to 10 μm in consideration of image quality, and more preferably from 6 to 10 μm in terms of cleanability.

A full-color image forming toner for use in the present invention is preferably formed of a toner including a first binder resin including a release agent (hydrocarbon waxes mentioned later), a second binder resin, a colorant and a charge controlling agent; and the above-mentioned external additive.

The first and second binder resins are not limited, and may be known resins for full-color toners such as polyester resins, (meth) acrylic resins, styrene-(meth) acrylic copolymer resins, epoxy resins and COC (cyclic olefin) resins, e.g., TOPAS-COC from Ticona. The polyester resins are preferably used for both of the first and second binder resins in terms of oilless fixation.

The polyester resin is typically formed by polycondensation between a polyol and a polycarboxylic acid.

Specific examples of diols in the polyols include adducts of a bisphenol A such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane; ethylene glycol; diethylene glycol; triethylene glycol; 1,2-propylene glycol; 1,3-propylene glycol; 1,4-butadieneol; neo-pentyl glycol; 1,4-butenediol; 1,5-pentanediol; 1,6-hexanediol; 1,4-cyclohexanedimethanol; dipropyleneglycol; polyethyleneglycol; polytetramethyleneglycol; bisphenol A; hydrogenated bisphenol A; etc. Specific examples of tri- or more valent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, etc.

Specific examples of dicarboxylic acids in the polycarboxylic acids include a maleic acid, a fumaric acid, a citraconic acids, an itaconic acid, a glutaconic acid, a phthalic acid, an isophthalic acid, a terephthalic acid, a cyclohexane dicarboxylic acid, a succinic acid, an adipic acid, a sebacic acid, an azelaic acid, a malonic acid, a n-dodecenylsuccinic acid, an isododecenylsuccinic acid, a n-dodecylsuccinic acids, an isododecylsuccinic acid, a n-octenylsuccinic acid, an isooctenylsuccinic acid, a n-octylsuccinic acid, an isooctylsuccinic acid, their anhydrides or lower alkyl esters, etc.

Specific examples of tri- or more carboxylic acids include a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra (methylenecarboxyl)methane, a 1,2,7,8-octantetracarboxylic acid, an empol trimer acid, and their anhydrides and lower alkyl esters, etc.

In the present invention, a vinyl polyester resin is preferably used, which is prepared by a combination of a polycondensation reaction forming a polyester resin and a radical polymerization reaction forming a vinyl resin in a same container, using a mixture of a polyester resin material monomer, a vinyl resin material monomer and a monomer reacting with the both material monomers.

The monomer reacting with the both material monomers is, i.e., a monomer usable in both of the polycondensation reaction and radical polymerization reaction. Namely, the monomer is a monomer having a polycondensation-reactable carboxyl group and a radical-polymerization-reactable vinyl group such as a fumaric acid, a maleic avid, an acrylic acid and a methacrylic acid.

The polyester resin material monomer includes the above-mentioned polyols and polycarboxylic acids. The vinyl material monomer includes styrenes or their derivatives such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins such as ethylene, propylene, butylene and isobutylene; methacrylate alkyl esters such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylate alkyl esters such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate and dodecylacrylate; unsaturated carboxylic acids such as an acrylic acid, a methacrylic acid, an itaconic acid and a maleic acid; acrylonitrile; maleate ester; itaconate ester; vinylchloride; vinylacetate; vinylbenzoate; vinylmethylethylketone; vinylhexylketone; vinylmethylether; vinylethylether; vinylisobutylether; etc.

Specific examples of a polymerization initiator for polymerizing the vinyl resin material monomer include azo or diazo polymerization initiators such as 2,2'-azobis(2,4-dimethylvaleronitrile), 2,2'-isobutyronitrile, 1,1'-azobis(cyclohexane-1-carbonitrile) and 2,2'-azobis-4-methoxy-2,4-dimethylvaleronitrile; and peroxide polymerization initiators such as benzoylperoxide, dicumylperoxide, methylethylketoneperoxide, isopropylperoxycarbonate and lauroylperoxide.

The first and second polyester resins are preferably used as a binder resin, and the following first and second binder resins are more preferably used in terms of improving the separativeness and offset resistance of the resultant oilless-fixing toner.

The first binder resin is a polyester resin prepared by polycondensating an adduct of bisphenol A with alkyleneoxide as the polyol, and a terephthalic acid and a fumaric acid as the polycarboxylic acid.

The second binder resin is a vinyl polyester resin prepared by using an adduct of bisphenol A with alkyleneoxide, a terephthalic acid, a trimellitic acid and a succinic acid as the polyester resin material monomer; styrene and butylacrylate as the vinyl resin material monomer; and a fumaric acid as the monomer reactive with both of the material monomers.

The first binder resin may include a hydrocarbon wax as mentioned above. In order to include a hydrocarbon wax in the first binder resin, the hydrocarbon wax is included in monomers forming the first binder resin when synthesized. For example, the hydrocarbon wax is included in an acid monomer and an alcohol monomer forming a polyester resin as the first binder resin, and the acid monomer and alcohol monomer are polycondensated. When the first binder resin is a vinyl polyester resin, the hydrocarbon wax is included in a polyester resin material monomer and a vinyl resin material monomer is dropped therein while stirred and heated to perform a polycondensation reaction and a radical polymerization reaction.

A toner for use in the present invention may include a release agent such as a wax, and may also include a wax dispersant aiding dispersion of a wax. The release agent included in a toner can maintain and improve separability between a transfer paper (recoding medium) from a fixer after a toner image formed on the paper is fixed thereon. The release agent included in a toner enable the fixer to fix the toner without oil, which can meet requirements of low cost and downsizing. A wax having a low polarity typically has better releasability from a fixing roller. Waxes for use in the present invention are preferably hydrocarbon waxes.

The hydrocarbon waxes are formed of only carbon atoms and hydrogen atoms, and includes neither of an ester group, an alcohol group and an amide group. Specific examples thereof include polyolefin waxes such as polyethylene, polypropylene, and an ethylene propylene copolymer; petroleum waxes such as a paraffin wax and a microcrystalline wax; and synthetic waxes such as a Fischer-Tropsch wax. Among these waxes, the polyethylene wax, paraffin wax and Fischer-Tropsch wax are preferably used, and the polyethylene wax and paraffin wax are more preferably used in the present invention.

The wax dispersants are not particularly limited, and known wax dispersants can be used. Specific examples thereof include polymers and oligomers including a block formed of a unit having high compatibility with a wax and a unit having high compatibility with a resin; polymers and oligomers wherein either of a unit having high compatibility with a wax and a unit having high compatibility with a resin is grafted with the other; copolymers of unsaturated hydrocarbons such as ethylene, propylene, butene, styrene and α-styrene and α,β-unsaturated carboxylic acids, their esters or anhydrides such as an acrylic acid, a methacrylic acid, a maleic acid, a maleic acid anhydride, an itaconic acid and an itaconic acid anhydride; and a block or grafted body of vinyl resins and polyester.

Specific examples of the unit having high compatibility with a wax include long-chain alkyl groups having 12 or more carbon atoms, polyethylene, polypropylene, polybutene, polybutadiene and their copolymers. Specific examples of the unit having high compatibility with a resin include polyesters and vinyl resins.

Known charge controlling agents conventionally used in full color toners can be used.

Specific examples thereof include Nigrosine dyes, triphenylmethane dyes, chromium-containing metal complex dyes, molybdic acid chelate pigments, Rhodamine dyes, alkoxyamines, quaternary ammonium salts (including fluorine-modified quaternary ammonium salts), alkylamides, phosphor and its compounds, tungsten and its compounds, fluorine-containing activators, metal salts of salicylic acid, metal salts of salicylic acid derivatives, etc. Specific examples of marketed charge controlling agents include BONTRON P-51 (quaternary ammoniumsalt), BONTRONE-82 (metal complexof oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc. Particularly, a charge controlling agent controlling a toner so as to have a negative polarity is preferably used.

The content of the charge controlling agent in the toner is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When greater than 10 parts by weight, the resultant toner has so much chargeability that the charge controlling agent has less effect and the electrostatic attraction of the toner to a developing roller increases, occasionally resulting in deterioration of fluidity of a developer and production of images having lower image density.

Specific examples of the colorants included in a toner for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmiumred, cadmiummercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used a lone or in combination. The toner particles preferably include the colorant in an amount of from 1 to 15% by weight, and more preferably from 3 to 10% by weight.

The colorant for use in the present invention can be used as a composite previously mixed with a binder resin, i.e., as a masterbatch.

Specific examples of the binder resins used for preparing the masterbatch and kneaded therewith include a rosin, a modified rosin, a terpene resin, aliphatic or alicyclic hydrocarbon resins, aromatic petroleum resins, chlorinated paraffins, paraffin waxes, etc. These can be used alone or in combination.

As mentioned above, in the present invention, a composite oxide including at least titanium oxide and a silicon oxide is used as an external additive. The composite oxide has a core-shell structure formed of a core including the titanium oxide and a shell including the silicon oxide, includes the titanium oxide in an amount of from 80 to 95% by weight, and has a BET specific surface area of from 50 to 100 $m^2/g$. The composite oxide preferably includes the titanium oxide in an amount of from 85 to 95% by weight.

The composite oxide having a core-shell structure including specific contents of the titanium oxide and the silicone oxide can be prepared by a gas phase method. When the composite oxide including the titanium oxide in an amount of from 80 to 95% by weight is used as an external additive, the resultant toner has good chargeability such as charge buildability while preventing the charging roller from being contaminated. It can be observed by a TEM when observing a cross-section of the composite oxide that the composite oxide including the titanium oxide in an amount of from 80 to 95% by weight has a core-shell structure including the titanium in the core and silicon oxide in the shell. Conventional gas phase methods can be used, e.g., silicon tetrachloride gas, titanium tetrachloride gas and inactive gas are placed in a mixing chamber equipped with a combustion burner, and mixed with hydrogen and air to obtain a mixed gas having a predetermined ratio. The mixed gas is burned in a reaction chamber to prepare the (particulate) composite oxide.

In addition, the external additive preferably has an adherence strength (P) of from 30 to 65% to a toner for use in the image forming method and the image forming apparatus of the present invention. The adherence strength (P) is determined by the following method.

After 2 g of a toner is fully blended with 30 ml of a surfactant solution diluted tenfold to prepare a mixture, an energy is applied thereto at 40 W for 1 min by an ultrasonic homogenizer to separate the external additive from the toner. Then, after the external additive is washed and dried, a ratio of an adherence amount thereof after (Wa) and before (Wb) separated from the toner, using a wavelength-dispersive X-ray fluorescence analyzer.

Namely, the ratio of an adherence amount of the external additive after separated from the toner (Wa) (pellet of 2 g) to an adherence amount before thereof separated from the toner (Wb) (pellet of 2 g) is measured, using a wavelength-dispersive X-ray fluorescence analyzer XRF1700 from Shimadzu Corp. An energy of $1N/cm^2$ was applied to 2 g of the toner for 60 sec to form the pellet thereof.

$$(P)=100\times Wa/Wb$$

When the adherence strength (P) is less than 30%, the free external additives increase to contaminate the charging roller. When greater than 65%, the external additive is likely to bury in the toner and the resultant toner does not improve in charge buildability, resulting in a feebly-charged toner producing foggy images.

The charging roller used as a charger in the image forming method and the image forming apparatus of the present invention preferably has a diameter of from 7 to 20 mm.

Namely, a combination of the charging roller having a ten-point average surface roughness Rz of from 5 to 30 and a toner having an external additive including the composite oxide having the core-shell structure prevents even a charging roller having a small diameter of from 7 to 20 mm from being contaminated and imparts good chargeability thereto.

When the charging roller has a diameter less than 7 mm, the roller is difficult to discharge due to a core material of the roller. When greater than 20 mm, the apparatus becomes large and costly.

The charging roller preferably has a cleaning member. The cleaning member further prevents the charging roller from being contaminated with a toner and an external additive. Namely, even when the charging roller has a cleaning member, the effect of the present invention can be exerted.

The image forming method and the image forming apparatus of the present invention preferably use a contact developing method of contacting a toner borne by an image developer to an electrostatic latent image bearer.

The contact developing method can prevent the charging roller from being contaminated in the present invention.

The electrostatic latent image bearer preferably has a cleaning blade. The cleaning blade in the image forming method of the present invention can prevent the charging roller from being contaminated and control the charge of a toner even when an external additive leaves therefrom.

The electrophotographic image forming apparatus of the present invention will be explained.

FIG. 1 is a schematic view for explaining the image forming apparatus of the present invention.

Numeral 1 is an electrostatic latent image bearer, and a charging roller (charger) 2 is located contacting the electrostatic latent image bearer 1. A voltage is provided from an electric source 3 to the charging roller 2. Around the electrostatic latent image bearer 1, an irradiator 4, an image developer 5, a transferee 6, a cleaner 7 and a discharger 8 are located. Numeral 9 is a fixer. A toner including at least a binder resin, a colorant and a release agent, and an external additive contained in the image developer 5 in FIG. 1 adheres to an electrostatic latent image to form a toner image.

Figure 2:
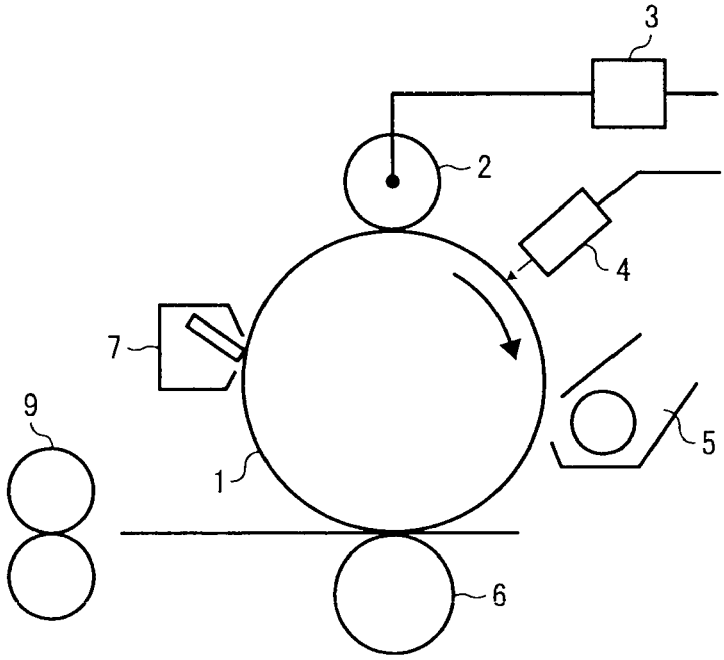
FIG. 2 is a schematic view for explaining another (erase less) electrophotographic image forming apparatus of the present invention.

FIG. 2 is an erase less image forming apparatus, and has no discharger 8 installed in the image forming apparatus in FIG. 1.

The charging roller 2 can have a cleaning member although not shown in FIGS. 1 and 2. A cleaning blade as a cleaner can be located around the electrostatic latent image bearer 1.

The image forming apparatus including at least the charger (charging roller), the image developer, the transferer and the fixer, in which a series of charging, irradiating, developing, transferring, discharging (optional) and re-charging processes are made to form images.

The image forming method and image forming apparatus of the present invention are capable of stably producing quality images without production of foggy and hazy images and meeting lower cost, downsizing and high-speed printing.

The process cartridge of the present invention, as mentioned above, detachable from an image forming apparatus, including an electrostatic latent image bearer; and at least one of a charger charging the surface of the electrostatic latent image bearer, an irradiator irradiating the charged surface of the electrostatic latent image bearer to form an electrostatic latent image thereon, an image developer developing the electrostatic latent image with a toner to form a toner image on the surface of the electrostatic latent image bearer, and a transferer transferring the toner image onto a recording medium is characterized in that the charger is a charging roller contacting the electrostatic latent image bearer to charge the electrostatic latent image bearer, having a ten-point surface roughness Rz of from 5 to 30, and the toner includes at least a binder resin, a colorant, a release agent and an external additive, that the external additive includes at least a composite oxide including titanium oxide and silicon oxide, and that the composite oxide has a core-shell structure formed of a core including the titanium oxide and a shell including the silicon oxide, includes the titanium oxide in an amount of from 80 to 95% by weight, and has a BET specific surface area of from 50 to 100 $m^2/g$.

The process cartridge can be expected to downsize and reduce cost, and the electrostatic latent image bearer and each of the other process means in a body having high relative positional preciseness improve image quality, produce high quality images even after repeatedly used for long periods. Further, the maintenance of the process cartridge is easy because the process means can be exchanged in a short time with ease.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 to 13 and Comparative Examples 1 to 8

[Image Forming Apparatus]

Ipsio SP C220 from Ricoh Company, Ltd., including an electrostatic latent image bearer with a cleaning blade, a charger using a charging roller with a cleaning member, an irradiator, an image developer using a contact developing method, a transferer and a fixer was modified so as to have charging rollers having different diameters, and further the cleaning member was removed therefrom.

The charging rollers were replaced as shown in Table 1, and the content of titanium oxide in the composite oxide used as an external additive of the toner and the BET specific surface area thereof were changed as shown in Table 2 to prepare combinations shown in Table 3.

[Preparation of Toner]

The following toner materials were fully mixed by Henschel Mixer to prepare a mixture.

| | |
|---|---|
| Polyester resin A having a softening point of 131° C. and an AV value of 25 | 68 |
| Polyester resin B having a softening point of 116° C. and an AV value of 1.9 | 32 |
| Cyan masterbatch including 50 parts of Pigment Blue 15:3 | 8 |
| Carnauba wax | 8 |

The mixture was melted and kneaded by a biaxial extruder PCM-30 from Ikegai Co., Ltd, from which a discharger was removed to prepare a kneaded mixture. The kneaded mixture was expanded upon application of pressure by a cooling press roller to have a thickness of 2 mm, cooled by a cooling belt and crushed by a feather mill to prepare a crushed mixture. The crushed mixture was pulverized by a mechanical pulverizer KTM from Kawasaki Heavy Industries, Ltd. to have an average particle diameter of from 10 to 12 μm, and further pulverized and roughly classified by a jet pulverizer IDS from Nippon Pneumatic Mfg. Co., Ltd. to prepare a pulverized mixture. The pulverized mixture was finely classified by a rotor classifier 100ATP from Hosokawa Micron Group to prepare a parent toner A having a volume-average particle diameter of 7.9 μm and an average circularity of 0.910.

Silica-titania composite oxides A to H shown in Table 2 each having a core-shell structure formed of a core including a titanium oxide and a shell including a silicon oxide were prepared by a gas phase method. Namely, silicon tetrachloride gas, titanium tetrachloride gas and inactive gas are placed in a mixing chamber equipped with a combustion burner, and mixed with hydrogen and air to obtain a mixed gas having a predetermined ratio. The mixed gas is burned in a reaction chamber to prepare a (particulate) composite oxide. The composite oxide I shown in Table 2 is $TiO_2$-SDS from Fuji Pigment Co., Ltd. A relative art is disclosed in Japanese published unexamined application No. 2004-17747.

One part of silica (RX200) [external additive 2] and 0.5 parts of the composite oxide [external additive 1] were added to 100 parts of the parent toner A according to Table 3 to prepare mixtures. Each of the mixtures was mixed by Henschel Mixer at a peripheral speed of 40 m/sec and the adherence strength (P) of the external additives to the parent toner was controlled by the mixing time to prepare toners in Examples 1 to 13 and Comparative Examples 1 to 8. The external additive 1 was not added in Comparative Example 1. The adherence strength (P) was determined by the above-mentioned formula (P)=100×Wa/Wb.

The charging roller and toner in the above-mentioned Ipsio SP C220 from Ricoh Company, Ltd. were changed to the charging rollers and toners shown in Table 3, and in every Example, after 1,000 pieces of a print pattern having an image area of 6% were continuously produced at 23° C. and 45% Rh, a halftone image and a blank image were produced to visually observe and evaluate them. Foggy images due to deterioration of charge buildability and uneven image density due to contamination of the charging roller were evaluated, based on the following standards.

◎: No problem

○: No problem on image quality although slight uneven image density and foggy images were observed X: Practically problem due to serious uneven image density and foggy images

TABLE 1

| Charging Roller | Ten-Point Average Surface Roughness Rz (μm) | Roller Diameter (mm) |
|---|---|---|
| Charging Roller A | 6 | 7 |
| Charging Roller B | 15 | 7 |
| Charging Roller C | 28 | 7 |
| Charging Roller D | 6 | 7 |
| Charging Roller E | 6 | 20 |
| Charging Roller F | 4.5 | 7 |
| Charging Roller G | 32 | 7 |
| Charging Roller H | 6 | 6 |

TABLE 2

| Composite Oxide | Content of Titanium Oxide (%) | BET Specific Surface Area ($M^2/g$) |
|---|---|---|
| Composite Oxide A | 80 | 95 |
| Composite Oxide B | 95 | 95 |
| Composite Oxide C | 80 | 51 |
| Composite Oxide D | 95 | 51 |
| Composite Oxide E | 75 | 95 |
| Composite Oxide F | 98 | 95 |
| Composite Oxide G | 80 | 45 |
| Composite Oxide H | 95 | 110 |
| Composite Oxide I | 70 | 90 |

TABLE 3

| | Charging Roller | External Additive 1 (Composite Oxide) | Adherence Strength of External Additive (%) | Image Evaluation: Foggy Image | Image Evaluation: Uneven Image Density |
|---|---|---|---|---|---|
| Example 1 | Charging Roller A | Composite Oxide A | 50 | ◎ | ◎ |
| Example 2 | Charging Roller B | Composite Oxide A | 50 | ◎ | ◎ |
| Example 3 | Charging Roller C | Composite Oxide A | 50 | ◎ | ◎ |
| Example 4 | Charging Roller D | Composite Oxide A | 50 | ◎ | ◎ |
| Example 5 | Charging Roller E | Composite Oxide A | 50 | ◎ | ◎ |
| Example 6 | Charging Roller A | Composite Oxide B | 50 | ◎ | ◎ |
| Example 7 | Charging Roller A | Composite Oxide C | 50 | ◎ | ◎ |
| Example 8 | Charging Roller A | Composite Oxide D | 50 | ◎ | ◎ |
| Example 9 | Charging Roller A | Composite Oxide A | 30 | ◎ | ◎ |
| Example 10 | Charging Roller A | Composite Oxide A | 65 | ◎ | ◎ |
| Example 11 | Charging Roller A | Composite Oxide A | 25 | ◎ | ○ |
| Example 12 | Charging Roller A | Composite Oxide A | 70 | ○ | ◎ |
| Example 13 | Charging Roller H | Composite Oxide A | 50 | ◎ | ○ |
| Comparative Example 1 | Charging Roller A | — | 50 | X | ○ |
| Comparative Example 2 | Charging Roller F | Composite Oxide A | 50 | ○ | X |
| Comparative Example 3 | Charging Roller G | Composite Oxide A | 50 | ○ | X |
| Comparative Example 4 | Charging Roller A | Composite Oxide E | 50 | ○ | X |
| Comparative Example 5 | Charging Roller A | Composite Oxide F | 50 | X | ○ |
| Comparative Example 6 | Charging Roller A | Composite Oxide G | 50 | ○ | X |
| Comparative Example 7 | Charging Roller A | Composite Oxide H | 50 | X | ○ |
| Comparative Example 8 | Charging Roller A | Composite Oxide I | 50 | ○ | X |

As Table 3 shows, Examples 1 to 13, each of which is a combination of a charging roller having a ten-point surface roughness Rz of from 5 to 30, an external additive of a toner, which is a composite oxide including titanium oxide and silicon oxide, having a core-shell structure formed of a core including the titanium oxide and a shell including the silicon oxide, which includes the titanium oxide in an amount of from 80 to 95% by weight, and has a BET specific surface area of from 50 to 100 $m^2/g$ has good evaluation results of foggy image and uneven image density. Each of Comparative Examples 1 to 8 has a problem of foggy image or uneven image density in practical use.

This application claims priority and contains subject matter related to Japanese Patent Application No. 2008-179612 filed on Jul. 7, 2008, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method, comprising:

charging a surface of an electrostatic latent image bearer by a charger;

irradiating a surface of the electrostatic latent image bearer by an irradiator to form an electrostatic latent image thereon;

developing the electrostatic latent image by an image developer with a toner to form a toner image;

transferring the toner image onto a recording medium by a transferer; and fixing the toner image on the recording medium by a fixer, wherein:

the charger comprises a charging roller contacting the electrostatic latent image bearer to charge the electrostatic latent image bearer, having a ten-point surface roughness Rz of from 5 to 30;

the toner comprises a binder resin, a colorant, a release agent and an external additive;

the external additive comprises a composite oxide comprising titanium oxide and silicon oxide;

the composite oxide has a core-shell structure comprising a core comprising the titanium oxide and a shell comprising the silicon oxide;

the titanium oxide is present in an amount from 80 to 95% by weight; and the composite oxide has a BET specific surface area of from 50 to 100 $m^2/g$.

2. The image forming method of claim 1, wherein the composite oxide is prepared by a gas phase method comprising burning silicon tetrachloride gas and titanium tetrachloride gas.

3. The image forming method of claim 1, wherein the external additive further comprises particulate silicon oxide.

4. The image forming method of claim 1, wherein the charging roller has a diameter of from 7 to 20 mm.

5. The image forming method of claim 1, wherein the charging roller comprises a cleaning member.

6. The image forming method of claim 1, wherein the external additive has an adherence strength (P) to the toner of from 30 to 65%, wherein the adherence strength (P) is determined by the following formula:

$$(P)=100\times Wa/Wb$$

wherein Wa is a ratio of an adherence amount of the external additive after separated from the toner, and Wb is an adherence amount thereof before separated from the toner, wherein the adherence amount is measured by a fluorescence X-ray analyzer.

7. The image forming method of claim 1, wherein the toner contacts the electrostatic latent image bearer when developing the electrostatic latent image.

8. The image forming method of claim 1, wherein the electrostatic latent image bearer comprises a cleaning blade.

* * * * *